US008621702B1

(12) United States Patent
Stewart

(10) Patent No.: US 8,621,702 B1
(45) Date of Patent: Jan. 7, 2014

(54) TOOL FOR SCRATCH TICKETS

(76) Inventor: Elaine Stewart, New York, NY (US)

( * ) Notice: Subject to any disclaimer, the term of this patent is extended or adjusted under 35 U.S.C. 154(b) by 0 days.

(21) Appl. No.: 13/135,773

(22) Filed: Jul. 14, 2011

Related U.S. Application Data

(60) Provisional application No. 61/365,400, filed on Jul. 19, 2010.

(51) Int. Cl.
*A46B 15/00* (2006.01)
*A47L 13/02* (2006.01)

(52) U.S. Cl.
USPC ..... 15/111; 15/236.01; 15/236.07; 30/169; D3/210; D4/118; D32/42; D32/46

(58) Field of Classification Search
USPC ..... 15/111, 236.01, 236.05–236.09; 30/169; D3/208, 210; D4/118; D32/42, D32/46–49
See application file for complete search history.

(56) References Cited

U.S. PATENT DOCUMENTS 5,586,357 A * 12/1996 Kosakowski et al. ..... 15/111
5,615,441 A * 4/1997 Savini ..... 15/111
6,141,999 A * 11/2000 Whittaker et al. ..... 70/456 R

* cited by examiner

*Primary Examiner* — Mark Spisich

(57) ABSTRACT

A tool with a handle (14) that can be used to removed film from printed matter. In addition, there is a small brush (16) used to cleaning film residue from printed matter. Further the toll will have a loop (18) or patch of hook/loop material (20) so that the tool can be attached to a linking device so that the tool can be easily hooked to a key chain, key ring, pant loop or any other item with attachment capability in order to make the tool readily available for immediate use.

1 Claim, 3 Drawing Sheets

TOOL FOR SCRATCH TICKETS

PRIORITY

This application claims priority to provisional application 61/365,400, filed Jul. 19, 2010.

BACKGROUND OF THE INVENTION

The present invention pertains to the art of tools for removing a film layer or coating from a printed matter such as a lottery ticket or game piece.

SUMMARY OF THE INVENTION

The tool is a small hard-surfaced too used to remove the top layer of film of coating off of printed matter to reveal info printed underneath the film coating. For example, a coupon or an ad campaign that offers a prize or other important information that is prized underneath a film coating and once the film is scratched off the prize of info is then revealed to the recipient.

The tool shape may circular, semicircular or any other shape that can be easily held in order to position it in way so that the film can easily be scratched off to reveal the printed information.

The tool may be made from any hard surfaced material such as metal that can be shaped or molded into the required size and that will provide a hard edge to easily and safely remove film coating. Materials that can be used could be aluminum, silver, steel, gold, tin, copper as well as plastic or wood. The design of the tool will be a small circular disk with an attached handle; sandwiched between or otherwise embedded on top of the handle will be a small brush that can be used for removing film shaving residue.

The tool would be marketed with several options to the consumer. The possibility that the tool may be made from a variety of metals either together in the product or as a separate metal choice that would depend on the most economical way to produce the tool or there may also be an option to produce the tool from a metal that may provide better longevity therefore this would be a metal option that would not be cost driven. Again, the tool may be bought and cold with or without an accompanying cleanup bag.

The tool could be marketed and cold but not limited to as a point of purchase from catering to the many vendors who sell lottery scratch off games as well as useful household or office tool that can be utilized in the home or office to remove the film from mail, magazine promotions and a hose of advertising campaigns that use the scratch off method as a way of communicating to the consumer.

The advantage of the tool is that there is a definite need for this type of easy to use film removing tool. Currently, there is no such tool available although the need is clearly there based on the amount of consumer products that are crated using film coating technology as a way of connecting to the consumer as is evident by the widespread advertising campaigns that use this method as well as high volume of scratch off games of chance that are bought by a huge and diverse cross-section of consumers.

DETAILED DESCRIPTION OF THE INVENTION

Figure 1:
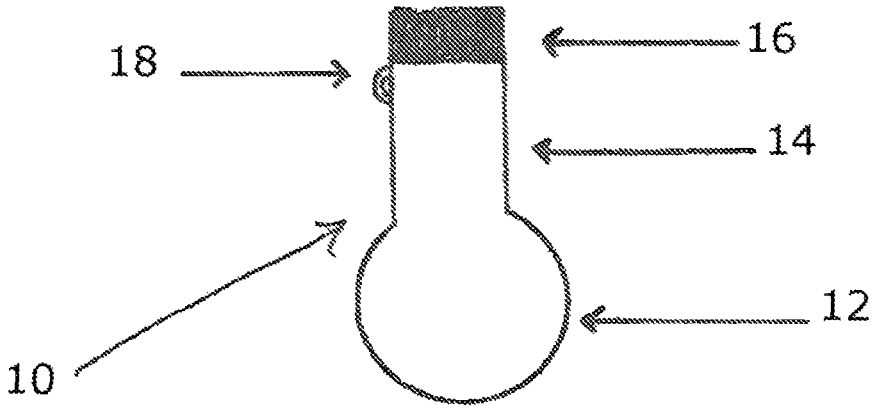
FIG. 1 is a front view of the tool.
Figure 2:
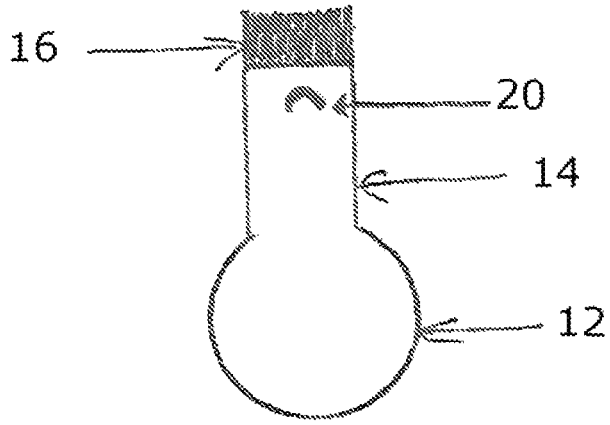
FIG. 2 is a rear view of the tool.
Figure 3:
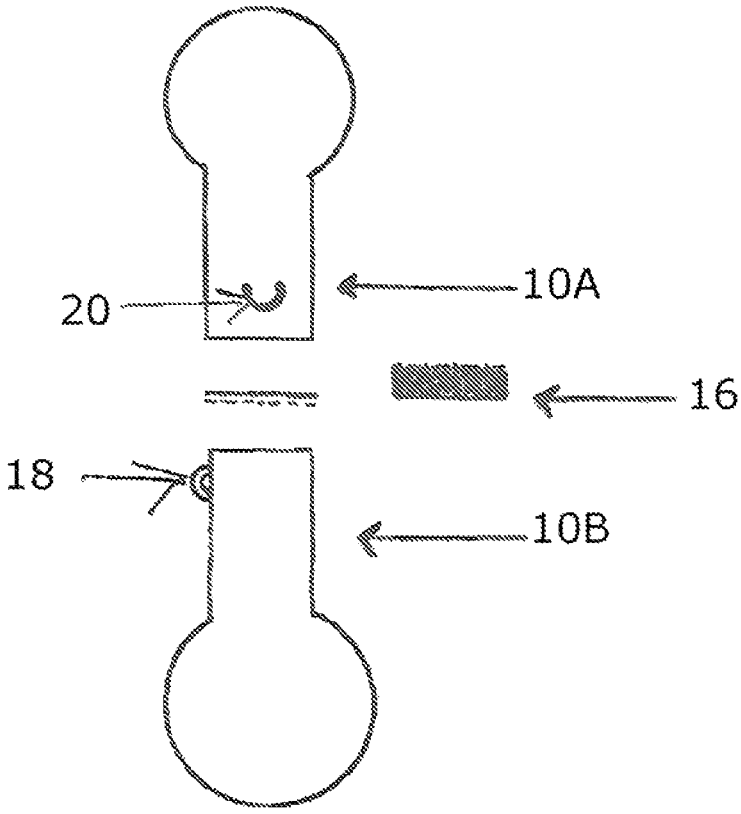
FIG. 3 is a view of the components of the tool prior to assembly.

The tool has a body (10) having at one end thereof a circular disk-shaped portion (12) and extending from the disk is an elongate handle member (14). The edge surface of the disk member (12) in use acting as a scraper for removing the film or coating from the printed matter such as a lottery ticket. With reference to FIG. 3, it is shown that the body (10) is formed by similarly-shaped body portions (10A,10B) that are secured to define the assembled body (10). At the end of the handle member (14) and between the pair of body portions (10A,10B) is a brush portion (16) sandwiched or otherwise embedded at the top of the handle portion. The brush portion being provided for removing film shaving residue.

There is also provided a loop (18) on one side of the handle that will allow the tool to be hooked onto a key chain, wallet or any other linking device that us suitable for the tool without making it too cumbersome for the consumer.

In addition, there is provided a patch of hook/loop material (20) on a back side of the tool that will allow for a small easy to use cleanup bag to be attached to it. A cleanup bag may or may not be sold with the tool; however, the backside hook/loop will make it easy for the consumer to always have a cleanup bag handy for easy and quick cleanup and for the disposal of film shaving residue.

I claim:

1. A tool for removing a film or coating from a scratch ticket comprising:

(a) a substantially planar body comprising a circular disk portion and an elongate handle portion extending from a periphery of the disk portion, said body being formed by joining a pair of substantially symmetrical body portions each of which includes half of said circular disk portion and said handle portion, said disk portion defining a scraping surface for removing the film or coating from the scratch ticket, (b) a brush portion extending from an end of the handle portion opposite the disk portion, the brush portion being located generally in the same plane as that of the body, the brush portion further being sandwiched between the pair of body portions, the brush portion adapted to remove any film or coating residue scraped from the ticket;

(c) a peripheral side portion of the handle portion adjacent the brush portion including a loop member for attaching the tool to an object such as a key chain; and (d) a patch of hook/loop material provided on a front or rear face of the body enabling the tool to be attached to another device having a cooperating patch of hook/loop material.

* * * * *

UNITED STATES PATENT AND TRADEMARK OFFICE

CERTIFICATE OF CORRECTION

PATENT NO. : 8,621,702 B1
APPLICATION NO. : 13/135773
DATED : January 7, 2014
INVENTOR(S) : Elaine Stewart It is certified that error appears in the above-identified patent and that said Letters Patent is hereby corrected as shown below:

On the Title Page

Abstract, line 1, “removed” should be --remove--

Abstract, line 3, “cleaning” should be --clean--

Abstract, line 4, “toll” should be --tool--

In the Specification

Column 1, line 16, “hard-surfaced too” should be --hard-surfaced tool--

Column 1, line 19, “campaign that offers” should be --campaign offers--

Column 1, line 20, “coating and once” should be --coating; once--

Column 1, line 23, “may circular” should be --may be circular--

Column 1, line 24, “in way” should be --in a way--

Column 1, line 39, “choice that would” should be --choice would--

Column 1, line 41, “longevity therefore” should be --longevity. Therefore--

Column 1, line 43, “bought and cold” should be --bought and sold--

Column 1, line 45, “marketed and cold” should be --marketed and sold--

Column 1, line 46, “purchase from” should be --purchase item--

Column 1, line 47, “as useful” should be --as a useful--

Signed and Sealed this
Twenty-third Day of September, 2014

Michelle K. Lee

Michelle K. Lee
*Deputy Director of the United States Patent and Trademark Office*

Column 1, line 49, “hose” should be --host--

Column 1, line 55, “crated” should be --created--

Column 1, line 58, “as well as high” should be --as well as the high--

Column 2, line 13, “acting” should be --acts--

Column 2, line 24, “us” should be --is--